United States Patent [19]

Veluswamy et al.

[11] 4,313,816

[45] Feb. 2, 1982

[54] STAGED TEMPERATURE COAL CONVERSION PROCESS

[75] Inventors: Lavanga R. Veluswamy, Houston; Peter S. Maa, Baytown, both of Tex.

[73] Assignee: Exxon Research & Engineering Co., Florham Park, N.J.

[21] Appl. No.: 180,543

[22] Filed: Aug. 25, 1980

[51] Int. Cl.[3] ..... C10G 1/00; C10G 1/06

[52] U.S. Cl. ..... 208/10; 208/8 LE

[58] Field of Search ..... 208/8 LE, 10

[56] References Cited

U.S. PATENT DOCUMENTS

| | | | |
|---|---|---|---|
| 3,030,297 | 4/1962 | Schroeder | 208/8 |
| 3,375,175 | 3/1968 | Eddinger et al. | 201/31 |
| 3,488,279 | 1/1970 | Schulman | 208/10 |
| 3,692,662 | 9/1972 | Wilson et al. | 208/8 |
| 3,966,585 | 6/1976 | Gray et al. | 208/131 X |
| 4,123,347 | 10/1978 | Maa | 208/10 x |

FOREIGN PATENT DOCUMENTS 2020691 11/1979 United Kingdom .

OTHER PUBLICATIONS

Bureau of Mines Bulletin 622 Hawk et al. U.S. Dept. of the Interior Bureau of Mines 1965.

*Primary Examiner*—Delbert E. Gantz
*Assistant Examiner*—William G. Wright
*Attorney, Agent, or Firm*—Yale S. Finkle

[57] ABSTRACT

Coal or similar liquefiable carbonaceous solids are converted into lower molecular weight liquids by contacting the feed solids with molecular hydrogen in the absence of externally added hydrocarbon liquids under liquefaction conditions during sequential residence in two or more liquefaction zones arranged in series and operated such that the temperature in each zone increases from the first to the final zone. The effluent from each liquefaction zone is passed to the next succeeding higher temperature zone in the series. No hydrocarbon liquids are added to the first zone in the series and the only liquids present in each succeeding zone of the series are the liquids in the effluent from the preceding zone. Liquid hydrocarbonaceous products are recovered from the effluent withdrawn from the last zone.

15 Claims, 1 Drawing Figure

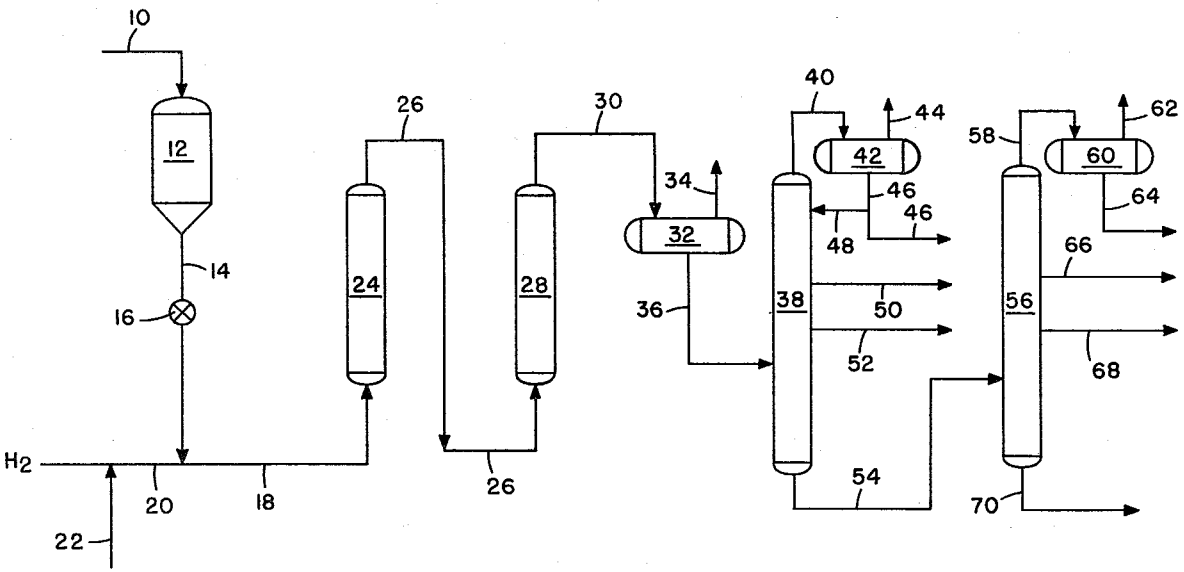
10
12
14
16
18
20
22
H2
24
26
26
28
30
32
34
36
38
40
42
44
46
46
48
50
52
54
56
58
60
62
64
66
68
70

STAGED TEMPERATURE COAL CONVERSION PROCESS

BACKGROUND OF THE INVENTION

This invention relates to the conversion of coal and similar carbonaceous solids into liquids and is particularly concerned with a staged temperature coal conversion process.

Among the more promising processes for the production of liquid hydrocarbons from coal are those in which the feed coal is first contacted with molecular hydrogen and a hydrogen-donor solvent in a liquefaction zone at elevated temperature and pressure to break down the complex high molecular weight constituent of the feed material into lower molecular weight hydrocarbon liquids and gases. A portion of the liquids produced in the liquefaction reactor are recovered and catalytically hydrogenated in a solvent hydrogenation reactor to generate the hydrogen-donor solvent required in the liquefaction step. The heavy liquefaction product, which normally boils in excess of 1000° F., recovered from the liquefaction reactor may be upgraded by subjecting it to pyrolysis to produce gases, additional hydrocarbon liquids, and coke which is subsequently steam gasified to form hydrogen and carbon monoxide for use as fuel.

Although the process outlined above has numerous advantages over other liquefaction processes and produces a relatively large amount of liquids, it does require the use of a hydrogen-donor solvent produced by hydrogenating a portion of the liquid product in an external catalytic hydrogenation reactor. The production of this hydrogen-donor recycle solvent stream via catalytic hydrogenation external to the liquefaction step adds appreciably to the cost of the process and it would therefore be economically attractive if the recycle stream could be eliminated without decreasing the liquid yield from the process.

SUMMARY OF THE INVENTION

The present invention provides an improved process for converting coal or similar liquefiable carbonaceous solids into lower molecular weight liquid hydrocarbons which at least in part alleviates the difficulties described above. In accordance with the invention, it has now been found that high yields of liquid products can be obtained from bituminous coal, subbituminous coal, lignite or similar solid carbonaceous feed materials without the use of an added hydrocarbon solvent or other liquid diluent by contacting the feed solids with molecular hydrogen under liquefaction conditions in the absence of externally added hydrocarbon liquids during sequential residence in two or more liquefaction zones arranged in series and operated such that the temperature in each zone increases from the first to the final zone of the series and the total of the residence times in all except the final zone of the series is sufficient to produce an increase in liquid yield over that obtainable by single stage liquefaction carried out under the conditions in the final zone. The effluent from each liquefaction zone excluding the final zone is passed to the next succeeding zone of higher temperature. In this manner the feed solids that are not liquified or converted into lower molecular weight liquids in the initial zone are at least partially liquefied in the second zone, the unconverted solids in the effluent from the second zone are at least partially liquefied in the third zone, and so forth until the final zone is reached. Here the remaining unconverted solids are subjected to a relatively high temperature, preferably greater than 790° F. for maximum conversion of solids into lower molecular weight liquids. The effluent from the last liquefaction zone is then treated to recover liquid hydrocarbonaceous products. Normally, no hydrocarbon liquids are added with the feed solids to the first liquefaction zone in the series and the only liquids introduced into each subsequent zone in the series are the liquids in the effluent from the preceding liquefaction zone. The liquefaction that takes place in each zone may be carried out in the presence or absence of an added hydrogenation catalyst. In general, the total residence time for all of the liquefaction zones combined, excluding the final zone, will normally be above about 40 minutes, preferably between about 60 and about 200 minutes. The residence time in the final zone will normally be between about 20 minutes and about 120 minutes, preferably between about 40 and about 90 minutes. The temperature in the initial zone will normally be at least about 650° F., preferably between about 680° F. and about 750° F. The temperature in the final zone will normally range between about 790° F. and about 900° F., preferably between about 820° F. and about 860° F.

As many liquefaction zones as are economically viable may be utilized. In the preferred embodiment of the invention, only two zones are used. The carbonaceous feed solids are contacted with molecular hydrogen in the absence of externally added hydrocarbon liquids under liquefaction conditions in the first liquefaction zone and the effluent from the first zone is subsequently subjected to liquefaction conditions in the presence of molecular hydrogen in the second liquefaction zone which is maintained at a temperature greater than the temperature in the first liquefaction zone. Normally the only hydrocarbon liquids introduced into the second liquefaction zone are the liquids produced in the first liquefaction zone. Unconverted high molecular weight constituents from the first liquefaction zone are further converted into lower molecular weight liquids in the second liquefaction zone. Preferably, the temperature in the second zone is between about 100° F. and about 150° F. greater than the temperature in the first zone. A liquid hydrocarbonaceous product is then recovered from the effluent of the second zone. The residence time utilized in the first liquefaction zone wll normally be greater, preferably between about 20 minutes and about 100 minutes greater than the residence time in the second liquefaction zone.

Studies indicate that the process of the invention produces liquid yields comparable to those obtained by single stage liquefaction carried out in the presence of an added hydrogen-donor solvent. Thus the process of the invention provides a method of dispensing with the need for a hydrogenated hydrocarbon solvent without significantly decreasing the amount of liquid product produced.

BRIEF DESCRIPTION OF THE DRAWING

The drawing is a schematic diagram of a staged temperature coal conversion process for producing liquid products from coal carried out in accordance with the invention.

DESCRIPTION OF THE PREFERRED EMBODIMENTS

In the process depicted in the drawing, the solid carbonaceous feed material is introduced into the system through line 10 from a preparation plant, not shown, in which the coal or other material may be crushed, dried and screened or from a storage facility which does not appear in the drawing. To facilitate handling of the solid feed material in the process, the coal or other carbonaceous solid is introduced into the system in a finely divided state, normally less than about 8 mesh on the U.S. Sieve Series Scale. The feed material employed in the process will normally consist of solid particles of bituminous coal, subbituminous coal, lignite, brown coal, or a mixture of two or more such materials. In lieu of coal, other carbonaceous solids may be employed. Such materials include organic waste materials, oil shale, tar sands, coke, coal char, liquefaction bottom, and the like.

The carbonaceous solids introduced through line 10 are fed into closed hopper or similar vessel 12 from which they are discharged through a star wheel feeder or equivalent device 16 in line 14 at an elevated pressure sufficient to permit their entrainment into a stream of high pressure hydrogen or hydrogen-containing gas introduced into line 18 via line 20. The majority of the hydrogen in line 20 is recovered in downstream steps of the process, not depicted in the drawing, and recycled to line 20 through line 22. The hydrogen and entrained solids are passed through line 18 into the bottom of first stage liquefaction reactor 24. Normally, no liquid phase or vapor phase hydrocarbon solvent is added to the liquefaction reactor with the entrained solids. Furthermore, no liquid hydrocarbons are normally introduced into the reactor from any external location. In lieu of or in addition to hopper 12 and star wheel feeder 16, the feed system may employ parallel lock hoppers, pressurized hoppers, aerated standpipes operated in series, or other apparatus to raise the input feed solid stream to the required pressure level.

The carbonaceous solids entrained in hydrogen gas are subjected to temperatures between about 680° F. and about 750° F., preferably between about 690° F. and about 720° F., as they pass upwardly through liquefaction reactor 24. The pressure in the reactor is maintained between about 300 psig and about 5000 psig, preferably between about 1500 psig and about 2500 psig. Normally, between about 4 weight percent and about 30 weight percent hydrogen, based on dry feed solids, is mixed with the feed solids injected into the liquefaction reactor. The residence time of the solids which pass through first stage reactor 24 will normally be above about 40 minutes and will preferably range from about 60 minutes to about 200 minutes. A residence time between about 120 minutes and about 170 minutes appears to be most preferable.

Within liquefaction reactor 24, the feed solids undergo liquefaction or chemical conversion into lower molecular weight constituents. The high molecular weight constituents of the carbonaceous feed solids are broken down and hydrogenated to form lower molecular weight gases and liquids. The hydrogen injected with the feed particles gives up hydrogen atoms that react with organic radicals liberated from the particles to stabilize them and thereby prevent their recombination. Normally, between about 0.5 and about 3.0 weight percent hydrogen based on dry feed solids will be consumed during the passage of the solids through the liquefaction reactor.

The effluent from first stage liquefaction reactor 24, which contains gaseous liquefaction products such as carbon monoxide, carbon dioxide, ammonia, hydrogen, hydrogen sulfide, methane, ethane, ethylene, propane, propylene and the like, unreacted hydrogen, light liquids, and heavier liquefaction products including mineral matter, unconverted feed solids and high molecular weight liquids is withdrawn from the top of the reactor through line 26, preheated and passed to second stage liquefaction reactor 28. Normally, all of the liquids, unconverted carbonaceous solids and mineral matter from reactor 24 are passed into reactor 28. The only source of hydrocarbon liquids injected into reactor 28 will be those produced in reactor 24. Hydrocarbon liquids from any other source are normally not added to reactor 28.

In second stage liquefaction reactor 28, the effluent from first stage liquefaction reactor 24 is subjected to further liquefaction at a temperature greater than the temperature in reactor 24, normally at a temperature between about 790° F. and about 900° F., preferably between about 820° F. and about 860° F. The pressure in the reactor will normally be maintained between about 300 psig and about 5000 psig preferably between about 1500 psig and about 2500 psig. The solids residence time within the second stage reactor 28 will normally range between about 20 minutes and about 120 minutes and will preferably be between about 40 minutes and about 90 minutes. The residence time in second stage liquefaction reactor 28 will normally be less than the residence time in first stage liquefaction reactor 24.

The reactions taking place in the liquefaction zone in second stage reactor 28 are similar to those that occur in first stage liquefaction reactor 24. The unconverted feed solids and high molecular weight constituents are broken down or cracked and then hydrogenated to form lower molecular weight gases and liquids. Molecular hydrogen in the gas phase gives up hydrogen atoms that react with organic radicals formed when the unconverted feed solids and high molecular weight constituents are cracked, thereby preventing their recombination and producing gases and lower molecular weight liquids. Normally, between about 0.5 weight percent and about 4 weight percent hydrogen, based upon the dry solids fed to first liquefaction reactor 24, is consumed during passage of the reactants through second stage liquefaction reactor 28.

In conventional coal liquefaction operations, coal is normally slurried with a hydrogen-donor solvent and then contacted with hydrogen in a liquefaction zone operated above about 800° F. A portion of the liquid product produced in the liquefaction zone is then subjected to catalytic hydrogenation in a hydrogenation zone external to the liquefaction zone to regenerate the hydrogen-donor solvent, which is then recycled to the process. The external hydrogenation of the coal liquids produced in the liquefaction zone and the recycle of the resultant hydrogen-donor solvent adds appreciably to the cost of the overall liquefaction process. It has now been found that liquid yields approaching those obtained in conventional hydrogen-donor liquefaction processes can be obtained without the use of either a vapor phase or liquid phase hydrogen-donor solvent by subjecting the coal or similar solid carbonaceous feed material to liquefaction in a plurality of liquefaction zones arranged in series and operated such that the temperature in each zone increases from the first to the final zone in the series. Normally, the total of the residence times in all except the final zone of the series is greater than the residence time in the final zone. No hydrocarbon liquids are added to the first zone in the series and the only hydrocarbon liquids present in that zone are those generated in situ. Any hydrocarbon liquids present in each succeeding zone in the series are liquids produced in the preceding zones that are passed into that zone. This process of staged temperature liquefaction can be as effective in obtaining conversion of coal into liquids as is a single stage liquefaction process in which the coal is slurried with a hydrogen-donor solvent prior to being subjected to liquefaction conditions. The process is effective in producing liquids with or without the presence of a hydrogenation catalyst in one or more of the liquefaction zones. Suitable catalysts that may be used in the process include compounds containing metals from Groups VB, VIIB and VIIIB of the Periodic Table. Compounds containing molybdenum, nickel, cobalt, zinc, and iron are particularly preferred. Examples of such compounds include ammonium heptamolybdate, phosphomolybdic acid, nickel sulfate, cobalt sulfate, and iron acetate.

The above-described process is based in part upon the discovery that high yields of liquids can be obtained by subjecting coal or similar solid carbonaceous feed material to liquefaction in the presence of hydrogen and in the absence of externally added hydrocarbon liquids in a liquefaction zone or series of such zones at relatively low temperatures and long residence times prior to subjecting the resultant conversion products to high temperature liquefaction. Normally, such a low temperature, long residence time liquefaction step is carried out at a temperature between about 680° F. and about 750° F. and at a residence time above about 40 minutes. Under such conditions a substantial number of high molecular weight coal constituents are broken down and hydrogenated to form lower molecular weight liquids thus resulting in at least partial liquefaction of the coal. In the preferred embodiment of the process of the invention as depicted in the drawing, the low temperature, long residence time liquefaction step is carried out in a single liquefaction zone represented by reactor 24 prior to high temperature, short residence time liquefaction in a second liquefaction zone represented by reactor 28.

It is not presently understood why increased amounts of low molecular weight liquids are produced in the process of the invention. It is theorized, however, that the increase in coal conversion is due, at least in part, to more effective stabilization of coal fragments or radicals by the staged temperature liquefaction. Coal consists of chemical bonds with various strengths. A low temperature will break weaker bonds; whereas a high temperature will break stronger bonds. If the coal is immediately subjected to a high temperature, the weaker bonds will break too rapidly, thereby producing an over-abundance of coal fragments at one time. Many of these fragments may not be stabilized in time by hydrogen and may recombine to form high molecular weight constituents. By liquefying the coal in a series of low temperature zones each operated at a higher temperature than the preceding zone, only a small portion of the bonds, the weaker bonds, are broken at a time. This in turn results in a more efficient stabilization of coal radicals thereby minimizing their recombination and producing higher yields of low molecular weight liquids. It is further theorized that the increase in liquid yield is also contributed to by the formation of a greater amount of hydrogenated species in the low temperature zones where thermodynamics favors hydrogenation of polyaromatics. These hydrogenated species are then more easily cracked into lower molecular weight liquids in the higher temperature zones.

Referring again to the drawing, the effluent from the second stage liquefaction reactor 28 is withdrawn from the top of the reactor through line 30 and passed to separator 32. Here the reactor effluent is separated, preferably at substantially liquefaction pressure, into an overhead vapor stream that is withdrawn through line 34 and a liquid stream removed through line 36. The overhead vapor stream is passed to downstream units where the ammonia, hydrogen, and acid gases are separated from the low molecular weight gaseous hydrocarbons, which are recovered as valuable by-products. The hydrogen recovered from the vapor stream is recycled to the process through line 22 for reuse in the liquefaction reactors. Some of the light hydrocarbons, such as methane and ethane, may be steam reformed to produce hydrogen that can also be recycled through line 22 or used elsewhere in the process where required.

The liquid stream removed from separator 32 through line 36 will normally contain low molecular weight liquids, high molecular weight liquids, mineral matter, and unconverted feed solids. This stream is passed through line 36 into atmospheric distillation column 38 where the separation of low molecular weight liquids from the high molecular weight liquids boiling above about 1000° F. and solids is begun. In the atmospheric distillation column the feed is fractionated and an overhead fraction composed primarily of gases and naphtha constituents boiling up to about 400° F. is withdrawn through line 40, cooled and passed to distillate drum 42 where the gases are taken off overhead through line 44. This gas stream may be employed as fuel gas for generation of process heat, steam reformed to produce hydrogen that may be recycled to the process where needed, or used for other purposes. Liquids are withdrawn from distillate drum 42 through line 46 and a portion of the liquids may be returned as reflux through line 48 to the upper portion of the distillation column. The remaining naphtha is recovered as product. An intermediate liquid fraction boiling below about 500° F. is withdrawn as product through line 50 and a heavier intermediate fraction composed primarily of constituents boiling below about 700° F. is withdrawn as product through line 52. The bottoms from the distillation column, composed primarily of constituents boiling in excess of 700° F. is withdrawn through line 54, heated to a temperature between about 600° F. and 775° F., and introduced into vacuum distillation column 56.

In the vacuum distillation column, the feed is distilled under reduced pressure to permit the recovery of an overhead fraction that is withdrawn through line 58, cooled and passed to distillate drum 60. Gases are removed from the distillate drum via line 62 and may either be used as fuel, passed to a steam reformer to produce hydrogen for recycling to the process where needed, or used for other purposes. Light liquids are withdrawn from the distillate drum through line 64 and recovered as product. A heavier intermediate fraction, composed primarily of constituents boiling below about 850° F., may be withdrawn from the vacuum distillation tower through line 66 and a still heavier sidestream may be withdrawn through line 68. The bottoms from the vacuum distillation column, which consists primarily of high molecular weight liquids boiling above 1000° F., mineral matter and unconverted feed solids, are withdrawn through line 70 and may be used as a fuel; passed to downstream units to undergo coking, pyrolysis, gasification, partial oxidation or some similar conversion process; or utilized for some other purpose.

In the embodiment of the invention described above and depicted in the drawing, the coal or similar carbonaceous feed material is subjected to staged temperature liquefaction in two consecutive liquefaction reactors each of which is maintained at a relatively constant temperature. It will be understood that the process of the invention is not limited to this method of increasing temperature. For example, the feed material can be subjected to linearly increasing temperatures for a specified period of time before it is subjected to a constant higher temperature for a predetermined period of time, which is normally shorter than the time period over which the linear increase in temperature takes place.

The nature and objects of the invention are further illustrated by the results of laboratory tests. The first series of tests illustrates that coal subjected to liquefaction in the absence of an added hydrocarbon solvent in a single liquefaction zone produces a liquid yield substantially less than that obtained by single stage liquefaction in the presence of an added hydrogen-donor solvent. The second series of tests illustrates that staged temperature liquefaction of a certain bituminous coal in two separate temperature zones in the absence of an externally added hydrocarbon solvent results in liquid yields that approach those obtained in single stage liquefaction carried out in the presence of an added hydrogen donor solvent and are greater than those obtained in single stage liquefaction carried out in the absence of an added solvent. The final series of tests illustrates that certain types of hydrogenation catalysts will increase the yield of liquids in both single stage and staged temperature liquefaction carried out in the absence of an externally added hydrocarbon solvent.

In the first series of tests, stainless steel tubing bombs having a volume between 35 and 37 milliliters were charged with 3 grams of either Illinois No. 6 bituminous coal or Wyodak subbituminous coal that was ground and screened to −100 mesh on the U.S. Sieve Series Scale. No hydrocarbon solvent was added to the bombs. Sufficient hydrogen was injected into the bombs to produce a pressure of either 650 psig or 1000 psig at 75° F. The bombs were agitated at 120 cycles per minute for a predetermined period of time in a fluidized sand bath heated to a temperature sufficient to provide the desired reaction temperature. After agitation, the bombs were cooled to room temperature and a final pressure was recorded. Gases were bled off overhead of the bombs, measured by glass bomb water displacement and analyzed by gas chromatography. A slurry consisting of high molecular weight carbonaceous particles and mineral matter suspended in liquid hydrocarbons was recovered from each bomb. Each slurry was washed by mixing it for five minutes with ten times its weight in cyclohexane. The mixture was then centrifuged for fifteen minutes at a speed of 2000 rpm. The upper layer, which was rich in cyclohexane, was decanted and the remaining bottom layer was remixed with cyclohexane and washed again as described above. This washing procedure was performed a total of five times. The amount of solid residue from each bomb that did not dissolve in the cyclohexane was measured. The amount of liquids produced in each bomb was then determined by subtracting the sum of the amount of gas and solids produced from the sum of 100 and the amount of hydrogen consumed. The resultant number represents the amount of both hydrocarbon liquids and water that was produced. The water make was not measured directly but was calculated from pressure readings taken during each run. From the data, it is reasonable to assume that about 5 weight percent water was produced in each run with Illinois No. 6 coal and about 8 weight percent water was produced in each run with Wyodak coal. For comparison purposes, runs were also made with the addition of a hydrogen-donor solvent to the tubing bombs and the liquid yield determined as described above. The solvent used contained a donatable hydrogen concentration of about 1.5 weight percent and a sufficient amount of the solvent was injected into the bomb to provide a solvent-to-coal ratio of about 1.6. The results of these tests are set forth in Table I below.

TABLE I

| | SINGLE STAGE LIQUEFACTION OF COAL | | | | | | | | |
|---|---|---|---|---|---|---|---|---|---|
| Run Number | 1 | 2 | 3 | 4 | 5 | 6 | 7 | 8 | 9 |
| Coal Type | Ill.#6 | Ill.#6 | Ill.#6 | Ill.#6 | Ill.#6 | Wyodak | Wyodak | Wyodak | Wyodak |
| Temperature, (°F.) | 700 | 840 | 840 | 840 | 840 | 700 | 840 | 840 | 840 |
| Residence Time, (min.) | 150 | 60 | 40 | 40 | 40 | 150 | 60 | 40 | 40 |
| $H_2$ Charge, (psig @ 75° F.) | 1000 | 1000 | 1000 | 650 | 650 | 1000 | 1000 | 1000 | 650 |
| Liquid Solvent Charged* (Solvent-to-coal wt. ratio) | — | — | — | — | 1.6 | — | — | — | 1.6 |
| Yields, Wt. % Dry Coal | | | | | | | | | |
| Gas | 3.3 | 8.7 | 7.8 | 6.4 | 10.0 | 7.0 | 13.2 | 12.4 | 13.2 |
| Liquids** | 14 | 24 | 25 | 20 | 39 | 10 | 26 | 23 | 37 |
| Bottoms | 84 | 68 | 69 | 75 | 53 | 84 | 63 | 66 | 53 |
| $H_2$ Consumption, Wt. % Dry Coal | 1.4 | 1.3 | 1.7 | 1.1 | 2.5 | 0.8 | 1.6 | 1.3 | 2.6 |

*Donatable hydrogen concentration of 1.5 wt. %
**Includes water and is equal to [(100 + $H_2$ consumption - (bottoms + gas)]

The first four runs listed in Table I are for single stage liquefaction of Illinois No. 6 coal in the absence of an added hydrocarbon solvent. These runs can be compared to run 5 which is for a single stage liquefaction of Illinois No. 6 coal in the presence of an added hydrogen-donor solvent. As can be seen from the data for these runs, liquid yields from liquefaction in the absence of a donor solvent are much lower than the liquid yields obtained with a donor solvent. Runs 6 through 9 indicate that similar results are obtained when Wyodak coal is liquefied in the absence of an added donor solvent. It can be seen by comparing runs 1 and 6 respectively with runs 2 through 4 and runs 7 and 8 that liquefaction in the absence of added donor solvent at a low temperature and long residence time will result in a liquid yield much lower than that obtained by liquefaction at a higher temperature and shorter residence time.

In the second series of tests, Illinois No. 6 bituminous coal and Wyodak subbituminous coal were treated in the manner descried in the preceding series of tests except that after each tubing bomb was subjected to the low temperature heating step for a particular residence time, it was removed from the sand bath and placed in a second sand bath maintained at a temperature sufficient to increase the temperature in the tubing bomb to a predetermined value which was maintained for a predetermined length of time to simulate a staged temperature liquefaction. The tubing bomb was then cooled and the same procedure as in the first series of tests was followed to analyze the products produced during liquefaction. The results of these tests are set forth below in Table II. For comparison purposes, the data for runs 5 and 9 in Table I are also included in Table II.

(2) mineral matter content, (3) chemical structure, and (4) the ability to absorb molecular hydrogen. As can be seen from runs 1 and 6 in Table I, the hydrogen consumption for a single stage of liquefaction in the absence of an added donor solvent is 1.4 weight percent for Illinois No. 6 coal and only 0.8 weight percent for Wyodak coal. Runs 10 and 15 in Table II indicate that staged temperature liquefaction with the first stage operated at the same conditions as the single stage in runs 1 and 6 results in a total (both stages) hydrogen consumption of 2.5 weight percent for Illinois No. 6 coal and 1.9 weight percent for Wyodak coal. This means that the hydrogen consumption in the second stage of the liquefaction process is 1.1 weight percent for both coals. Thus, it appears that hydrogen consumption in the first stage is an important factor for producing liquids in a staged temperature liquefaction process carried out in the absence of an externally added donor solvent. The ability

TABLE II

| | STAGED TEMPERATURE LIQUEFACTION OF COAL | | | | | | | | | |
|---|---|---|---|---|---|---|---|---|---|---|
| Run Number | 10 | 11 | 12 | 13 | 14 | 5 | 15 | 16 | 17 | 9 |
| Coal Type | I11.#6 | I11.#6 | I11.#6 | I11.#6 | I11.#6 | I11.#6 | Wyodak | Wyodak | Wyodak | Wyodak |
| First Stage Temp., (°F.) | 700 | 700 | 700 | 700 | 700 | — | 700 | 750 | 750 | — |
| First Stage Residence Time, (minutes) | 150 | 120 | 120 | 60 | 60 | — | 150 | 40 | 40 | — |
| Second Stage Temp., (°F.) | 840 | 840 | 840 | 840 | 840 | 840 | 840 | 840 | 840 | 840 |
| Second Stage Residence Time, (minutes) | 60 | 40 | 40 | 60 | 40 | 40 | 60 | 40 | 40 | 40 |
| $H_2$ Charge, (psig @ 75° F.) | 1000 | 1000 | 650 | 1000 | 1000 | 650 | 1000 | 1000 | 650 | 650 |
| Liquid Solvent Charged* (solvent-to-coal wt. ratio) | — | — | — | — | — | 1.6 | — | — | — | 1.6 |
| Yields, Wt. % Dry Coal | | | | | | | | | | |
| Gas | 8.8 | 8.0 | 7.2 | 8.7 | 7.5 | 10.0 | 12.4 | 11.4 | 10.6 | 13.2 |
| Liquids** | 37 | 33 | 30 | 33 | 30 | 39 | 28 | 25 | 23 | 37 |
| Bottoms | 56 | 61 | 65 | 61 | 65 | 53 | 62 | 65 | 67 | 53 |
| $H_2$ Consumption, Wt. % Dry Coal | 2.5 | 2.1 | 1.6 | 2.4 | 2.4 | 2.5 | 1.9 | 1.3 | 0.9 | 2.6 |

*Donatable hydrogen concentration of 1.5 wt. %
**Includes water and is equal to [(100 + $H_2$ consumption - (bottoms + gas)]

Runs 10 through 14 in Table II show the results obtained for staged temperature liquefaction of Illinois No. 6 coal in the absence of an externally added solvent. By comparing run 10 with runs 1 and 2 in Table I, it can be seen that the staged temperature operation substantially increases the yield of liquids. It can also be seen by comparing runs 10 through 14 with run 5 that liquid yields from staged temperature liquefaction will approach the liquid yields from liquefaction in the presence of an externally added hydrogen-donor solvent if the first stage is operated at a relatively low temperature and a relatively long residence time as compared to the second stage. It would appear from runs 10 and 13, and 11 and 14 that a longer residence time in the first stage will result in the production of more liquids.

Runs 15 through 17 in Table II indicate that the liquid yields from staged temperature liquefaction of Wyodak coal in the absence of an externally added donor solvent are much less than those obtained with Illinois No. 6 coal, and are also considerably less than those obtained by single stage liquefaction of Wyodak coal in the presence of an externally added donor solvent (run 9). Furthermore, as can be seen by comparing run 15 in Table II with run 7 in Table I, there is only a slight increase in liquid yield for staged temperature liquefaction in the absence of an externally added donor solvent. It is not clear why Wyodak subbituminous coal behaves differently than Illinois No. 6 bituminous coal under similar staged temperature conditions. Four possible reasons for the lower liquid yields may be differences in the following properties of the coals: (1) caking tendencies, of Illinois No. 6 coal to absorb more hydrogen than Wyodak coal in the first stage of liquefaction may be one of the reasons for the greater liquid yields observed when using Illinois No. 6 coal. Another reason for the greater liquid yield may be the fact that Illinois No. 6 coal contains a much higher sulfur content than Wyodak coal. In general, it may be preferable to use a feed material which contains a total sulfur content greater than 1.0 weight percent based on dry feed material.

The third series of tests was conducted to investigate the effect of various catalysts on both single stage and staged temperature liquefaction of coals in the absence of an added hydrogen-donor solvent. Single stage runs were conducted in tubing bombs in the same manner as described for the first series of tests except that the coal charged to the tubing bombs was ground and screened to between 30 and 100 mesh on the U.S. Sieve Series Scale. All runs were made at a temperature of 840° F. for a period of 60 minutes. Runs were conducted on both Illinois No. 6 coal and Wyodak coal with and without catalysts. When a catalyst was utilized, it was impregnated onto the coal from an aqueous solution prior to charging the coal into the tubing bomb. Staged temperature runs were carried out with both Illinois No. 6 and Wyodak coals in the same manner as discussed in the second series of tests except that the coal charged to the tubing bombs was ground and screened to between 30 and 100 mesh on the U.S. Sieve Series Scale. The first stage temperature and residence time were 700° F. and 150 minutes, respectively. The second stage temperature and resdience time were 840° F. and 60 minutes, respectively. The results of these tests are set forth in Table III below.

TABLE III

| | | | CATALYTIC LIQUEFACTION OF COAL | | | | | | | |
|---|---|---|---|---|---|---|---|---|---|---|
| | | | Single Stage* | | | | Staged Temperature* | | | |
| Coal | Catalyst | Loading | Gases | Liquids** | Bottoms | $H_2$ Consumed | Gases | Liquids** | Bottoms | $H_2$ Consumed |
| Ill. No. 6 | — | — | 8.2 | 22 | 71 | 1.3 | 8.3 | 27 | 66 | 2.0 |
| Ill. No. 6 | $CoSO_4$ | 200 ppm Co | 7.4 | 25 | 68 | 1.3 | 7.7 | 33 | 61 | 2.0 |
| Ill. No. 6 | $NiSO_4 . 6H_2O$ | 200 ppm Ni | 8.3 | 31 | 61 | 1.5 | 8.5 | 38 | 56 | 2.3 |
| Ill. No. 6 | $(NH_4)_6Mo_7O_{24} . 4H_2O$ | 200 ppm Mo | 9.4 | 33 | 58 | 1.8 | 8.4 | 47 | 48 | 2.8 |
| Wyodak | — | — | 12.8 | 25 | 64 | 1.6 | 11.6 | 29 | 62 | 2.0 |
| Wyodak | $NiSO_4 . 6H_2O$ | 200 ppm Ni | 12.4 | 26 | 64 | 2.2 | 13.5 | 27 | 62 | 2.1 |
| Wyodak | $(NH_4)_6Mo_7O_{24} . 4H_2O$ | 200 ppm Mo | 12.8 | 25 | 64 | 1.8 | 14.8 | 33 | 55 | 2.8 |

*All values are in wt. % based on dry coal
**Includes water and is equal to [(100 + $H_2$ consumption - (bottoms + gas)]

As can be seen from Table III, the presence of catalyst increases liquid yields for both single stage and staged temperature liquefaction of Illinois No. 6 in the absence of an added donor solvent. Single stage liquefaction of Wyodak coal in the presence of a catalyst, however, results in no increase in the yield of liquids and there is only a slight increase in liquid yield for staged temperature liquefaction of Wyodak coal in the presence of ammonium heptamolybdate. The use of ammonium heptamolybdate with Illinois No. 6 coal results in a large increase in liquid yield—over 10 weight percent for single stage liquefaction and over 20 weight percent for staged temperature liquefaction. It is not presently understood why cobalt sulfate, nickel sulfate and ammonium heptamolybdate are effective in substantially increasing liquid yields from Illinois No. 6 coal but not Wyodak coal.

It will be apparent from the preceding discussion that the invention provides an improved process for converting coal into a liquid product which results in a substantial liquid yield without the use of a hydrogen-donor solvent.

We claim:

1. A process for converting coal or similar liquefiable carbonaceous solids into lower molecular weight liquid hydrocarbons which comprises:

(a) contacting said carbonaceous solids with molecular hydrogen in the absence of externally added hydrocarbon liquids under liquefaction conditions during sequential residence in two or more liquefaction zones arranged in series and operated such that (i) the temperature in each zone increases from the first to the final zone of the series and (ii) the total of the solids residence times in all except the final zone of the series is greater than about 40 minutes, wherein said carbonaceous solids are partially converted into lower molecular weight liquid hydrocarbons in each of said liquefaction zones and the only hydrocarbon liquids added to each liquefaction zone subsequent to said first liquefaction zone are the liquids in the effluent from the preceding liquefaction zone; and (b) recovering liquid hydrocarbonaceous product from the effluent of said final liquefaction zone.

2. A process as defined in claim 1 wherein said first liquefaction zone is operated at a temperature between about 680° F. and about 750° F.

3. A process as defined in claim 1 wherein said carbonaceous solids comprise bituminous coal.

4. A process as defined in claim 1 wherein said first liquefaction zone is operated at a temperature in the range between about 690° F. and about 720° F. and said final liquefaction zone is operated at a temperature in the range between about 820° F. and about 860° F.

5. A process as defined in claim 1 wherein two liquefaction zones are employed in step (a).

6. A process as defined in claim 1 wherein said carbonaceous solids comprise a bituminous coal and are contacted in said liquefaction zones in the presence of an added hydrogenation catalyst selected from the group consisting of compounds containing nickel, molybdenum, and cobalt.

7. A process for converting coal or similar liquefiable carbonaceous solids into lower molecular weight liquid hydrocarbons which comprises:

(a) contacting said carbonaceous solids with molecular hydrogen under liquefaction conditions in the absence of externally added hydrocarbon liquids in a first liquefaction zone wherein the solids residence time is greater than about 40 minutes to at least partially convert said solids into lower molecular weight liquid hydrocarbons thereby producing a liquefaction effluent;

(b) subjecting said liquefaction effluent from said first liquefaction zone to liquefaction conditions in the presence of molecular hydrogen in a second liquefaction zone maintained at a temperature greater than the temperature in said first liquefaction zone thereby further converting said carbonaceous solids into lower molecular weight hydrocarbons, wherein the only hydrocarbon liquids added to said second liquefaction zone are the liquids in said liquefaction effluent from said first liquefaction zone; and (c) recovering liquid hydrocarbonaceous products from the effluent of said second liquefaction zone.

8. A process as defined in claim 7 wherein said carbonaceous solids comprise bituminous coal.

9. A process as defined in claim 7 wherein said solids residence time in said first liquefaction zone is between about 60 and about 200 minutes and said solids residence time in said second liquefaction zone is between about 20 and about 120 minutes.

10. A process as defined in claim 7 wherein the temperature in said first liquefaction zone is between about 680° F. and about 750° F. and the temperature in said second liquefaction zone is between about 790° F. and about 900° F.

11. A process as defined in claim 7 wherein the pressure in said first liquefaction zone is between about 1500 psig and about 1500 psig and the pressure in said second liquefaction zone is between about 1500 psig about 2500 psig.

12. A process as defined in claim 7 wherein said carbonaceous solids comprise coal containing a total sulfur content greater than about 1.0 weight percent based on dry coal and a hydrogenation catalyst selected from the group consisting of compounds containing nickel, cobalt, and molybdenum is present in each of said zones.

13. A process as defined in claim 12 wherein said hydrogenation catalyst comprises ammonium heptamolybdate.

14. A process as defined in claim 7 wherein said carbonaceous solids comprise coal having a total sulfur content greater than about 1.0 weight percent based on dry coal.

15. A process as defined in claim 7 wherein the solids residence time in said first liquefaction zone is greater than the solids residence time in said second liquefaction zone.

* * * * *